US007520795B2

(12) United States Patent
Wang et al.

(10) Patent No.: US 7,520,795 B2
(45) Date of Patent: Apr. 21, 2009

(54) GROOVED RETAINING RING

(75) Inventors: Shi-Ping Wang, Fremont, CA (US); Alain Duboust, Sunnyvale, CA (US); Antoine P. Manens, Santa Clara, CA (US); Wei-Yung Hsu, Santa Clara, CA (US); Jose Salas-Vernis, Santa Clara, CA (US); Zhihong Wang, Santa Clara, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 11/468,267

(22) Filed: Aug. 29, 2006

(65) Prior Publication Data

US 2007/0044913 A1 Mar. 1, 2007

Related U.S. Application Data

(60) Provisional application No. 60/713,103, filed on Aug. 30, 2005.

(51) Int. Cl.
*B24B 1/00* (2006.01)
*B24B 41/06* (2006.01)

(52) U.S. Cl. ..... 451/36; 451/288; 451/398

(58) Field of Classification Search ..... 451/36, 451/41, 59, 63, 285, 286, 287, 288, 289, 451/290, 398, 402
See application file for complete search history.

(56) References Cited

U.S. PATENT DOCUMENTS

| | | | | |
|---|---|---|---|---|
| 5,738,574 | A | 4/1998 | Tolles et al. | |
| 5,944,593 | A | 8/1999 | Chiu et al. | |
| 6,224,472 | B1 | 5/2001 | Lai et al. | |
| 6,251,215 | B1 | 6/2001 | Zuniga et al. | |
| 6,527,624 | B1 * | 3/2003 | Tolles et al. | 451/41 |
| 6,869,335 | B2 | 3/2005 | Taylor | |
| 6,962,520 | B2 * | 11/2005 | Taylor | 451/41 |
| 7,029,375 | B2 * | 4/2006 | Phang et al. | 451/41 |
| 7,118,456 | B2 | 10/2006 | Moloney | |
| 2003/0171076 | A1 | 9/2003 | Moloney | |
| 2004/0018804 | A1 | 1/2004 | Taylor | |
| 2005/0126708 | A1 * | 6/2005 | Chen et al. | 156/345.14 |
| 2005/0282322 | A1 | 12/2005 | Manens et al. | |
| 2006/0137819 | A1 | 6/2006 | Manens et al. | |

OTHER PUBLICATIONS

International Search Report and Written Opinion of the International Searching Authority, PCT Application Serial No. PCT/US2006/034106, Dec. 6, 2006, 7 pp.

* cited by examiner

*Primary Examiner*—Timothy V Eley
(74) *Attorney, Agent, or Firm*—Fish & Richardson

(57) ABSTRACT

A retaining ring for chemical mechanical polishing is described. The ring has a bottom surface with non-intersecting grooves. Alternating grooves are at opposing angles to one another.

15 Claims, 2 Drawing Sheets

GROOVED RETAINING RING

CROSS-REFERENCE TO RELATED APPLICATIONS

This application claims the benefit of priority of U.S. Provisional Application Ser. No. 60/713,103, filed on Aug. 30, 2005, which is incorporated by reference herein.

BACKGROUND

The present invention relates generally to chemical mechanical polishing of substrates, and more particularly to a retaining ring for use in chemical mechanical polishing.

An integrated circuit is typically formed on a substrate by the sequential deposition of conductive, semiconductive or insulative layers on a silicon substrate. One fabrication step involves depositing a filler layer over a non-planar surface, and planarizing the filler layer until the non-planar surface is exposed. For example, a conductive filler layer can be deposited on a patterned insulative layer to fill the trenches or holes in the insulative layer. The filler layer is then polished until the raised pattern of the insulative layer is exposed. After planarization, the portions of the conductive layer remaining between the raised pattern of the insulative layer form vias, plugs and lines that provide conductive paths between thin film circuits on the substrate. In addition, planarization is needed to planarize the substrate surface for photolithography.

Chemical mechanical polishing (CMP) is one accepted method of planarization. This planarization method typically requires that the substrate be mounted on a carrier or polishing head of a CMP apparatus. The exposed surface of the substrate is placed against a rotating polishing disk pad or belt pad. The polishing pad can be either a "standard" pad or a fixed-abrasive pad. A standard pad has a durable roughened surface, whereas a fixed-abrasive pad has abrasive particles held in a containment media. The carrier head provides a controllable load on the substrate to push it against the polishing pad. A polishing slurry, including at least one chemically-reactive agent, and abrasive particles if a standard pad is used, is supplied to the surface of the polishing pad.

SUMMARY

In one aspect, the invention is directed to a retaining ring that is a generally annular body having a top surface, a bottom surface, an inner diameter surface, and an outer diameter surface. The bottom surface includes a plurality of channels where a first of the channels is at a first angle to a radial segment of the retaining ring that intersects the first of the channels and a second of the channels is at a second angle to the radial segment of the retaining ring that intersects the second of the channels. The first angle is different from the second angle and the first channel does not intersect the second channel.

Embodiments of the invention can include one or more of the following features. The first angle can be at an approximately 90° angle to the second angle. The ring can have 18 or 26 channels. In some embodiments, the first channel does not contact the second channel. The bottom surface can include a first set of channels, each at the first angle, and a second set of channels, each at the second angle. The channels of the first set alternating with channels of the second set across the bottom of the surface of the substrate. The first set of channels can include channels that are at about a 45° angle to the radial segment corresponding to each channel and the second set of channels can include channels that are at about a 135° angle to a radial segment corresponding to each channel. The retaining ring can be a two part retaining ring.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
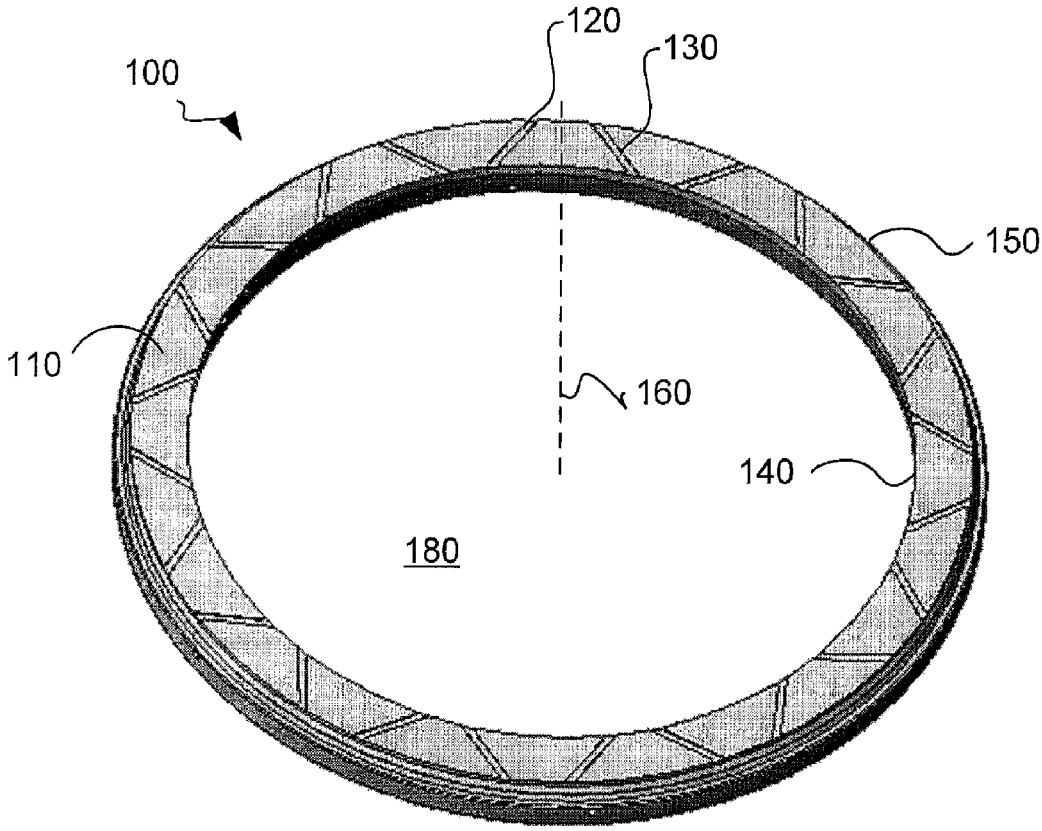
FIG. 1 is a perspective view of the retaining ring.

Referring to FIG. 1, a retaining ring 100 is a generally an annular ring that can be secured to a carrier head of a CMP apparatus. A suitable CMP apparatus is described in U.S. Pat. No. 5,738,574 and a suitable carrier head is described in U.S. Pat. No. 6,251,215, the entire disclosures of which are incorporated herein by reference.

The retaining ring 100 has a flat bottom surface 110 which includes channels 120, 130 or grooves. The channels 120, 130 begin at the inner circumference 140 and end at the outer circumference 150 of the bottom surface 110. In some embodiments, the channels 120, 130 are distributed at equal angular intervals around the retaining ring 100. The channels 120, 130 are grouped into two sets. The first set of channels 120 are typically oriented at 45° relative to a radial segment 160 extending through the center of the retaining ring 100, but other angles of orientation, such as between 30° and 60°, are possible. The second set of channels 130 are typically oriented at 135° relative to a radial segment 160, such as between 120° and 150°. That is, the channels in the first and second sets of channels are not parallel to one another or are at opposing angles to one another.

In some embodiments, alternating channels are oriented at approximately the same angle from their associated radial segment. This forms a pattern that is somewhat like a V-pattern on the bottom surface 110 of the retaining ring. However, adjacent channels do not intersect on the surface of the retaining ring. Each channel 120, 130 is an individual channel that neither intersects or overlaps with a neighboring channel. If the channels were extended beyond the surface of the retaining ring, the channels would intersect at approximately a 90° angle to one another, but the angle could be between 75° and 105°. The channels can be straight or be curved. The channels can have a width of about 0.1 to about 0.2 inches, such as around 0.125 inches. The channels can be between about 0.1 and 0.2 inches deep, such as around 0.120 inches deep.

The retaining ring 100 can be formed from a material that is chemically inert to the CMP process. The material should be sufficiently elastic that contact of the substrate edge against the retaining ring 100 does not cause the substrate to chip or crack. However, the retaining ring 100 should not be so elastic as to extrude into a substrate receiving recess 180 when the carrier head puts downward pressure on the retaining ring 100. The retaining ring 100 should also be durable and have a low wear rate, although it is acceptable for the retaining ring 100 to wear away. For example, the retaining ring 100 can be made of a plastic, such as polyphenylene sulfide (PPS), polyethylene terephthalate (PET), polyetheretherketone (PEEK), polybutylene terephthalate (PBT), polytetrafluoroethylene (PTFE), polybenzimidazole (PBI), polyetherimide (PEI), or a composite material.

The top surface of the retaining ring includes holes to receive bolts, screws, or other hardware for securing the retaining ring 100 and carrier head together (there could be a different number of holes). Additionally, one or more alignment apertures can be located in the upper portion. If the retaining ring 100 has an alignment aperture, the carrier head can have a corresponding pin that mates with the alignment aperture when the carrier head and retaining ring 100 are properly aligned. The retaining ring 100 can also include drain holes for draining any slurry out of the ring.

The retaining ring 100 can be constructed from one or two pieces. If the retaining ring 100 has both a lower portion and an upper portion, the upper portion can have a flat bottom surface and a top surface that is parallel to a bottom surface. The bottom surface of the upper portion mates with the upper surface of the lower portion. The two parts can be joined using an adhesive, screws, or a press-fit configuration. The adhesive layer can be a two-part slow-curing epoxy, such as Magnobond-6375™, available from Magnolia Plastics of Chamblee, Ga.

The upper portion can be formed from a rigid material, such as metal. Suitable metals for forming the upper portion include stainless steel, molybdenum, or aluminum. Alternatively, a ceramic can be used.

When the retaining ring 100 is secured to a base of a carrier head, the circumference of the top of the outer diameter can be substantially the same as the circumference of the base of the carrier head so that no gap exists along the outer edge of the carrier head.

In normal operation of the CMP apparatus, a robotic arm moves a 300 mm substrate from cassette storage to a transfer station. At the transfer station, the substrate is centered in the loadcup. The carrier head moves into place above the loadcup. Once the carrier head and loadcup are generally aligned with one another, the carrier head is lowered into position to collect the substrate.

Once the substrate has been loaded into the carrier head, the carrier head lifts away from the loadcup. The carrier head can move from the transfer station to each of the polishing stations on the CMP apparatus. The polishing station can include a platen on which a specific slurry is applied during polishing. During CMP polishing, the carrier head applies pressure to the substrate and holds the substrate against the polishing pad. During the polishing sequence, the substrate is located within a receiving recess, which prevents the substrate from escaping. The channels 120, 130 in the retaining ring 100 facilitate the transport of slurry to and from the substrate when the retaining ring 100 is in contact with the polishing pad. The opposing channel or dual-swirl configuration improves the mass transfer of slurry during the polishing process. A first set of the channels is oriented in one direction with respect to the closest radial segment to each channel. These channels push slurry into the recess 180. The opposing second set of channels spin slurry out of the recess 180. The slurry that is pushed out of the recess 180 can include used slurry and polish by-product.

The channels are not overlapping, which prevents slurry that is being pushed out of the recess of the retaining ring from being pushed immediately back into the recess, which may occur if the grooves overlapped.

Once polishing at a first polishing station is completed, the carrier head can move the substrate to a next polishing station.

The dual-swirl channel design described above can be an efficient way to eliminate cross contamination between polishing stations or platens. In some polishing systems, the slurries used at two different polishing stations are not compatible with one another. The retaining ring, head and substrate are rinsed between stations. For a conventional system, using the best known method, a sufficient rinse time for eliminating slurry on a retaining ring having a single set of channels all oriented in the same direction is between about 15-20 seconds. The dual swirl retaining ring rinse time can be as short as 5-10 seconds. The carrier head spins during rinsing. In the dual swirl retaining ring, the spinning in combination with the clockwise grooves allows the rinsing liquid to enter the recess of the ring and the counter-clockwise grooves allow by-products from the polishing process to exit the recess of the ring.

Figure 2:
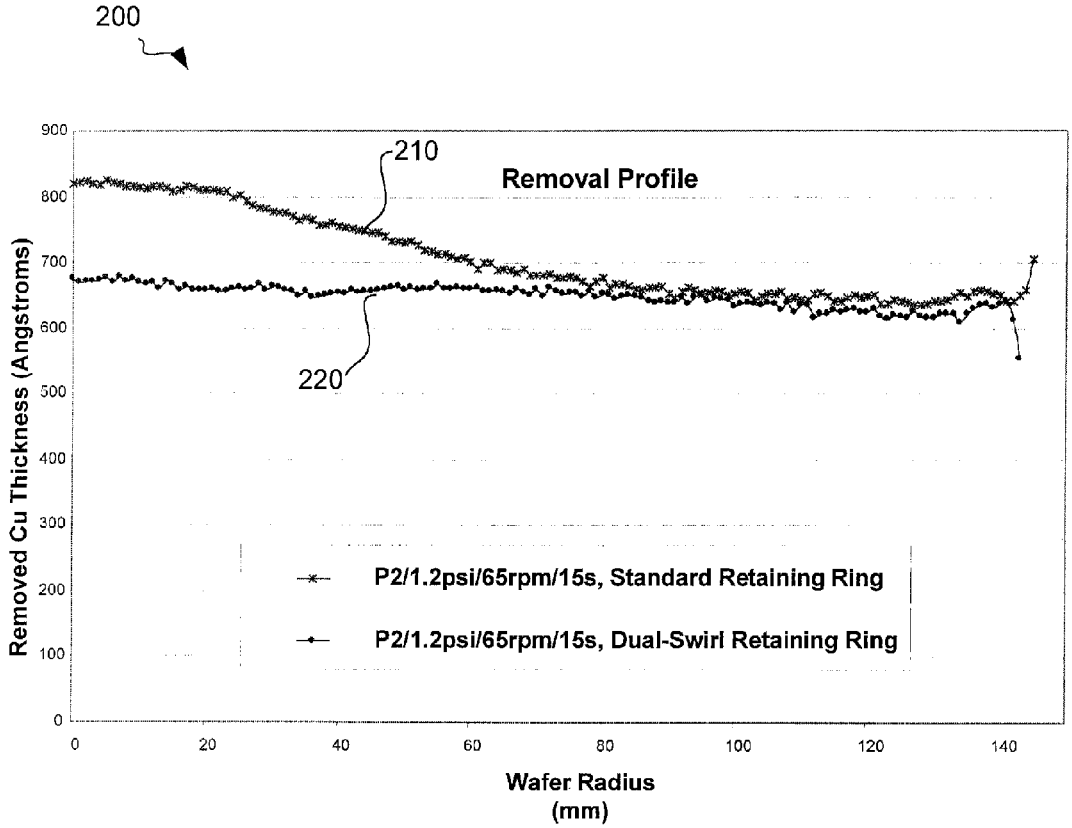
FIG. 2 is a graph comparing the performance of a conventional retaining ring with the retaining ring described herein.

Referring to FIG. 2, the dual-swirl retaining ring can provide an improved polishing profile and topography of a polished substrate over conventional polishing methods. Results 210 are from a conventional retaining ring without the opposing channels. The conventional retaining ring has 18 channels all oriented in the same direction, clockwise, to push slurry into the head during polishing. The two rings were used to remove copper from a surface of a substrate. The polishing tools were both run at 65 rpm for 15 seconds with a gauge pressure of 1.2 psi applied to the back side of the substrate. Results 220 are for a dual-swirl retaining ring having two sets of channels on a bottom surface, each set including 18 channels. As can be seen in graph 200, the removal profile across a substrate polished with the conventional retaining ring is uneven across the surface of the substrate. More copper was removed from the center of the substrate than from the edge. In particular, more than 800 Angstroms of copper were removed from the center of the substrate where around 650 Angstroms or less of copper were removed from near the edge of the substrate. Using the dual-swirl retaining ring, between about 600 and 700 Angstroms of copper were removed from across the surface of the substrate. The variation with the dual-swirl retaining ring is less than 100 Angstroms.

A number of embodiments of the invention have been described. Nevertheless, it will be understood that various modifications may be made without departing from the spirit and scope of the invention. For example, the dual swirl concept can be applied to retaining rings which include conductive portions for electrochemical mechanical polishing, such as those described in "Retaining Ring with Conductive Portion", U.S. application Ser. No. 11/127,790, filed May 11, 2005, and "Biased Retaining Ring" U.S. application Ser. No. 11/003,083, filed Dec. 2, 2004, and published on Jun. 29, 2006, under publication no. U.S. 2006-0137819 A1. Accordingly, other embodiments are within the scope of the following claims.

All references motioned herein are incorporated in their entirety for all purposes.

What is claimed is:

1. A retaining ring for chemical mechanical polishing, comprising:

a substantially annular ring having a bottom surface, the bottom surface including a plurality of pairs of adjacent channels, each of the channels extending from an inner diameter of the annular ring to an outer diameter of the annular ring, wherein a first channel of each of the pairs of adjacent channels is at a first angle to a radial segment of the retaining ring that intersects the first channel and a second channel of each of the pairs of adjacent channels is at a second angle to the radial segment of the retaining ring that intersects the second of the channels, the first angle being different from the second angle, the first channel not intersecting the second channel, the first channel being closer to the second channel than to any other channel, and the channels being straight.

2. The retaining ring of claim 1, wherein the first angle is at an approximately 90° angle to the second angle.

3. The retaining ring of claim 1, wherein the ring has at least eighteen channels.

4. The retaining ring of claim 1, wherein the first channel does not contact the second channel.

5. The retaining ring of claim 1, wherein the first channel of each of the pairs of adjacent channels is at about a 45° angle to a corresponding radial segment and the second channel of each of the pairs of adjacent channels is at about a 135° angle to a corresponding radial segment.

6. The retaining ring of claim 1, wherein the ring includes 36 channels.

7. The retaining ring of claim 1, wherein the annular ring has an upper portion and a lower portion formed of a different material than the upper portion.

8. The retaining ring of claim 7, wherein the lower portion comprises a plastic.

9. The retaining ring of claim 7, wherein the upper portion comprises a metal.

10. The retaining ring of claim 7, wherein the upper portion comprises a ceramic.

11. A method of making a retaining ring, comprising forming a retaining ring according to claim 1 by forming the plurality of pairs of channels in the substantially annular ring.

12. A method of polishing, comprising:

retaining a substrate within a retaining ring according to claim 1 and holding the substrate against a surface of a polishing pad; and creating a relative motion between the substrate and the polishing pad, wherein the relative motion causes slurry to be transported through the pairs of channels.

13. The method of claim 12, wherein slurry is transported to the substrate through the first channel of each of the pairs of channels and transferred away from the substrate through the second channel of each of the pairs of channels.

14. The retaining ring of claim 1, further comprising:

an upper surface having:

a plurality of holes configured to allow the retaining ring to be attached to a carrier head; and an alignment aperture configured to align the retaining ring to the carrier head.

15. A retaining ring for chemical mechanical polishing, comprising:

a substantially annular ring having:

an upper portion and a lower portion formed of a different material than the upper portion, the upper portion being more rigid than the lower portion; and a bottom surface, the bottom surface including a plurality of pairs of adjacent channels, each of the channels extending from an inner diameter of the annular ring to an outer diameter of the annular ring, wherein a first channel of each of the pairs of adjacent channels is at a first angle to a radial segment of the retaining ring that intersects the first channel and a second channel of each of the pairs of adjacent channels is at a second angle to the radial segment of the retaining ring that intersects the second of the channels, the first angle being different from the second angle, the first channel not intersecting the second channel, the first channel being closer to the second channel than to any other channel, the first channel not contacting the second channel, and the channels being straight.

* * * * *